US005953561A

United States Patent [19]

Tashiro et al.

[11] Patent Number: 5,953,561

[45] Date of Patent: Sep. 14, 1999

[54] PROCESS CARTRIDGE FOR USE IN IMAGE FORMING APPARATUS

[75] Inventors: Susumu Tashiro; Naoki Otomo; Mitsugu Nemoto; Yutaka Miyasaka; Motozi Kawamoto; Kazunori Katada, all of Hachioji, Japan

[73] Assignee: Konica Corporation, Japan

[21] Appl. No.: 09/121,089

[22] Filed: Jul. 23, 1998

[30] Foreign Application Priority Data

Aug. 5, 1997 [JP] Japan ..... 9-210566

[51] Int. Cl.[6] ..... G03G 21/16

[52] U.S. Cl. ..... 399/111; 399/122

[58] Field of Search ..... 399/111, 113, 399/114, 122, 25

[56] References Cited

U.S. PATENT DOCUMENTS

| | | | |
|---|---|---|---|
| 5,103,261 | 4/1992 | Matsuo et al. | 399/112 |
| 5,390,006 | 2/1995 | Wakabayashi et al. | 399/92 |
| 5,402,212 | 3/1995 | Ito et al. | 399/111 |
| 5,575,942 | 11/1996 | Watanabe | 219/469 |
| 5,695,902 | 12/1997 | Mikuriya et al. | 430/110 |

FOREIGN PATENT DOCUMENTS

| | | |
|---|---|---|
| 2-019858 | 1/1990 | Japan . |
| 2149859 | 2/1990 | Japan . |
| 219858 | 2/1990 | Japan . |
| 2272462 | 2/1990 | Japan . |
| 229767 | 2/1990 | Japan . |
| 450952 | 4/1992 | Japan . |
| 8123295 | 8/1996 | Japan . |

*Primary Examiner*—William Royer
*Assistant Examiner*—Greg Moldafsky
*Attorney, Agent, or Firm*—Jordan B. Bierman; Bierman, Muserlian and Lucas

[57] ABSTRACT

A process cartridge for use in an image forming apparatus, includes: a photoreceptor for bearing an image thereon; a processing member for image formation; and a heat roller included in a heat fixing device for fixing a developed image formed on a recording sheet. The photoreceptor, the processing member and the heat roller are integrally provided on the process cartridge which is attachable to the image forming apparatus.

14 Claims, 7 Drawing Sheets

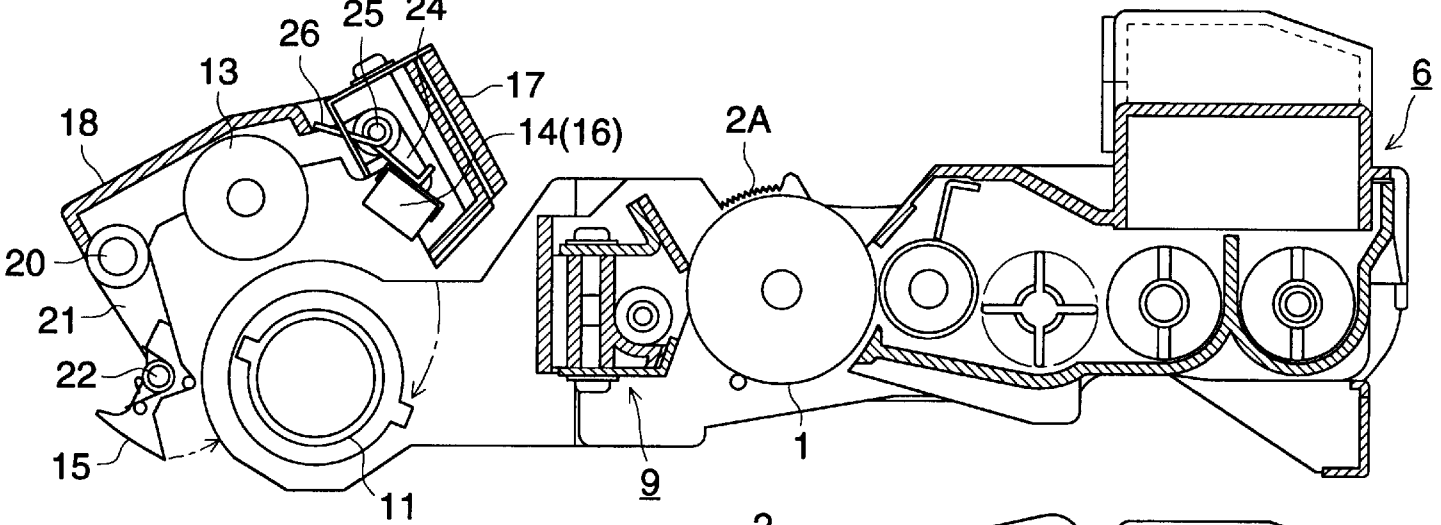
FIG. 7 ( a )
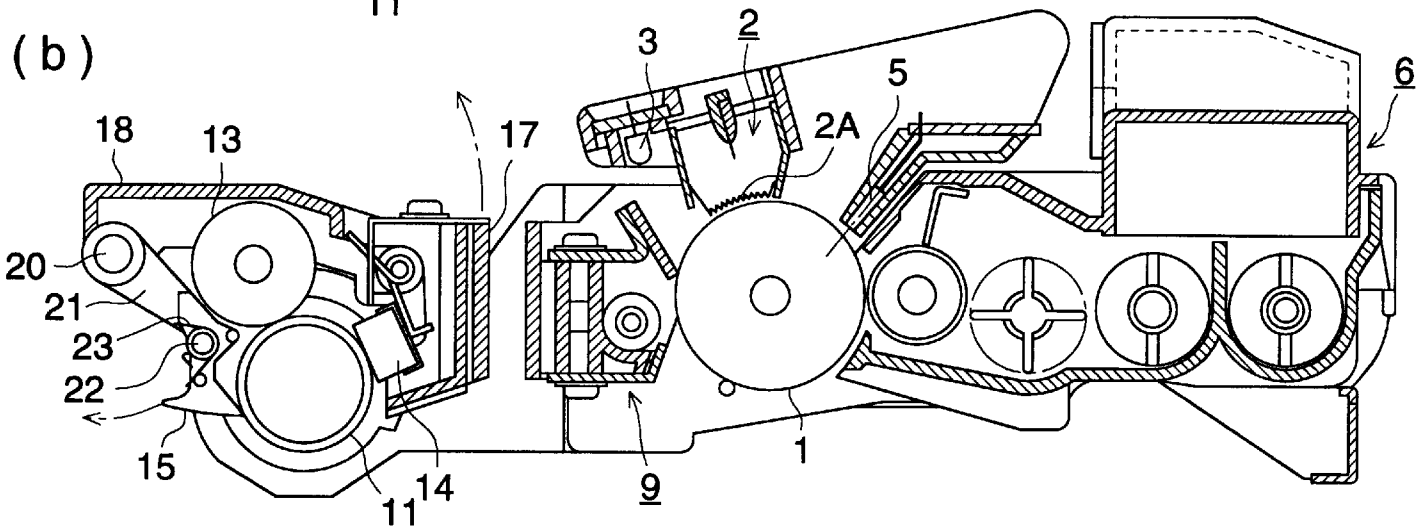
FIG. 7 ( b )

PROCESS CARTRIDGE FOR USE IN IMAGE FORMING APPARATUS

BACKGROUND OF THE INVENTION

The present invention relates to an image forming apparatus such as a copying machine of an electrophotographic type, a printer and a facsimile machine, and in particular, to a process cartridge which is capable of being mounted on or dismounted from an image forming apparatus having therein a heating and fixing unit.

A process cartridge is structured as a unit which contains in its housing an image carrier (a photoreceptor drum), a developing unit and other processing members. When developing agents in a developing unit and an image carrier are deteriorated to lower image quality, the process cartridge is removed from the main body of an image forming apparatus to be replaced with a new process cartridge.

Some image forming apparatuses in which the process cartridge of this kind is loaded employ toner of a heat-fixing type as developing agents and a fixing-heat roller in a heat-fixing device. In the heat-fixing device, a transfer material onto which an unfixed developed image has been transferred is nipped between the fixing-heat roller and a pressure roller to be conveyed, and thereby the unfixed developed image is heated and fused to be transferred onto the transfer material. A conventional heat-fixing device has been provided on the part of the main body of an image forming apparatus.

The fixing device described in Japanese TOKKAIHEI No. 2-29767 is one wherein a fixing cartridge including a heat roller is structured to be capable of being mounted on and dismounted from the main body of an apparatus, and a slidable power-supplying member which slides on a power-receiving member for the heat roller of the fixing cartridge is provided on the part of the main body of an apparatus.

With regard to the process cartridge and the image forming apparatus in Japanese TOKKAIHEI No. 2-19858, a fixing film which moves solidly with a transfer material and a roller around which the fixing film is wound are housed in the process cartridge which houses therein an image carrier and other process units and is capable of being mounted on and dismounted from the image forming apparatus.

The image forming apparatus in Japanese TOKKAIHEI No. 2-149859 is an image forming apparatus wherein a cleaner for fixing is provided to be capable of being mounted on and dismounted from a process cartridge having therein a drum-shaped photoreceptor, a developing unit and a cleaning device.

The printer in Japanese TOKKAIHEI No. 2-272462 is one wherein a unit in which a photoreceptor drum, a charging device, a developing device, a transfer device, a toner cartridge, a toner collecting device, a waste toner container and a cleaning pad for a fixing roller are integrally formed is capable of being mounted on and dismounted from the main body of the printer.

The image recording apparatus in Japanese TOKKAIHEI No. 4-50952 is one wherein a part of a heating means of a heat-fixing device and a photoreceptor cleaning device are united to be one body which is capable of being mounted on and dismounted from the main body of the image recording apparatus, and heat energy of the heating means is impressed on collected toner.

The electrophotographic apparatus in Japanese TOKKAIHEI No. 8-123295 is one wherein a fixing device representing a heating body is provided in the main body of the electrophotographic apparatus, a photoreceptor belt is provided on a process unit, and an infrared ray reflecting member is mounted on an enclosure of the process unit that faces the fixing device.

(1) In the prior art, a process cartridge and a fixing-heat roller are structured to be separate from each other, and the fixing-heat roller is provided on the part of the main body of an image forming apparatus. Even in the case where the process cartridge and the fixing-heat roller are the same in terms of life, the process cartridge has been capable of being mounted on and dismounted from the main body of the apparatus. On the occasion of maintenance of the apparatus, it has been necessary to remove the process cartridge and a fixing-heat roller supporting member separately and to replace them or to clean them, requiring much manhours for maintenance.

(2) Since a photoreceptor drum and the fixing-heat roller are provided respectively on different units, adjustment has been needed for maintaining their positional relation (parallelism).

(3) Since a conveyance unit having a fixing-pressure roller which is supported rotatably on the apparatus main body is made to hit a part of a process cartridge, the position where the process cartridge is supported is important.

(4) In the event of maintenance, when parts requiring no replacement are provided on a process unit, the process unit proves to be expensive when the unit is replaced.

(5) Even in the case of cleaning of the process unit instead of replacing thereof, cleaning is easy if no parts are arranged around the fixing-heat roller.

SUMMARY OF THE INVENTION

An object of the invention is to solve the problems stated above.

A process cartridge of the image forming apparatus having the first structure of the invention achieving the object mentioned above is represented by a process cartridge of an image forming apparatus in which the process cartridge provided at least with a photoreceptor carrying an image and an image forming process member is made to be capable of being mounted on and dismounted from the main body of the image forming apparatus, wherein a fixing-heat roller of a heat-fixing device which heats and fixes an unfixed developed image formed on a recording sheet is attached on the process cartridge to be united thereto, and the fixing-heat roller is made to be capable of being mounted on and dismounted from the main body of the image forming apparatus together with the process cartridge.

A process cartridge of the image forming apparatus having the second structure of the invention is represented by a process cartridge of an image forming apparatus in which the process cartridge provided at least with a photoreceptor carrying an image and an image forming process member is made to be capable of being mounted on and dismounted from the main body of the image forming apparatus, wherein a guide pin for positioning or a reference hole for positioning is provided at a prescribed position on each of the forward housing and the rear housing of the process cartridge to be engaged with a reference hole or a guide pin provided fixedly at a prescribed position on the main body of the image forming apparatus, and thereby the process cartridge is positioned and mounted on the main body of the image forming apparatus.

A process cartridge of the image forming apparatus having the third structure of the invention is represented by a process cartridge of an image forming apparatus in which the process cartridge provided at least with a photoreceptor carrying an image and an image forming process member is made to be capable of being mounted on and dismounted from the main body of the image forming apparatus, wherein there is formed, on an outer circumferential surface protruded outside against a panel of the image forming apparatus, a part of a bearing member which supports rotatably, with bearing members provided between a front panel and a rear panel of the main body of the image forming apparatus, a rotary shaft of a sheet-ejecting roller positioned at the downstream side of a fixing-heat roller of a heat-fixing device which heats and fixes an unfixed developed image formed on a recording sheet, and supports a rotary shaft of the sheet-ejecting roller on this side where the process cartridge is loaded, and the outer circumferential surface of the bearing member is caused to serve also as a reference pin for positioning the process cartridge on the main body of the image forming apparatus.

A process cartridge of the image forming apparatus having the fourth structure of the invention is represented by a process cartridge of an image forming apparatus in which the process cartridge provided at least with a photoreceptor carrying an image and an image forming process member is made to be capable of being mounted on and dismounted from the main body of the image forming apparatus, wherein a fixing sensor, a fixing abnormal temperature detector, a fixing cleaner and a fixing member of a fixing separating claw all provided around a fixing-heat roller of the process cartridge move in the direction to leave the outer circumferential surface of the fixing-heat roller, interlocking with loading of the process cartridge, and at least one fixing member is installed at a prescribed position around the fixing-heat roller when loading of the process cartridge on the main body of the image forming apparatus has been completed.

BRIEF DESCRIPTION OF THE DRAWINGS

FIG. 7(*a*) is a longitudinal section showing a process cartridge before installation on an image forming apparatus, while FIG. 7(*b*) is a longitudinal section showing a process cartridge after installation on an image forming apparatus.

DETAILED DESCRIPTION OF THE PREFERRED EMBODIMENT

Prior to explanation of an embodiment of the invention, an image forming apparatus equipped with a process cartridge of the invention will be explained with reference to a sectional view in FIG. 1.

Figure 1:
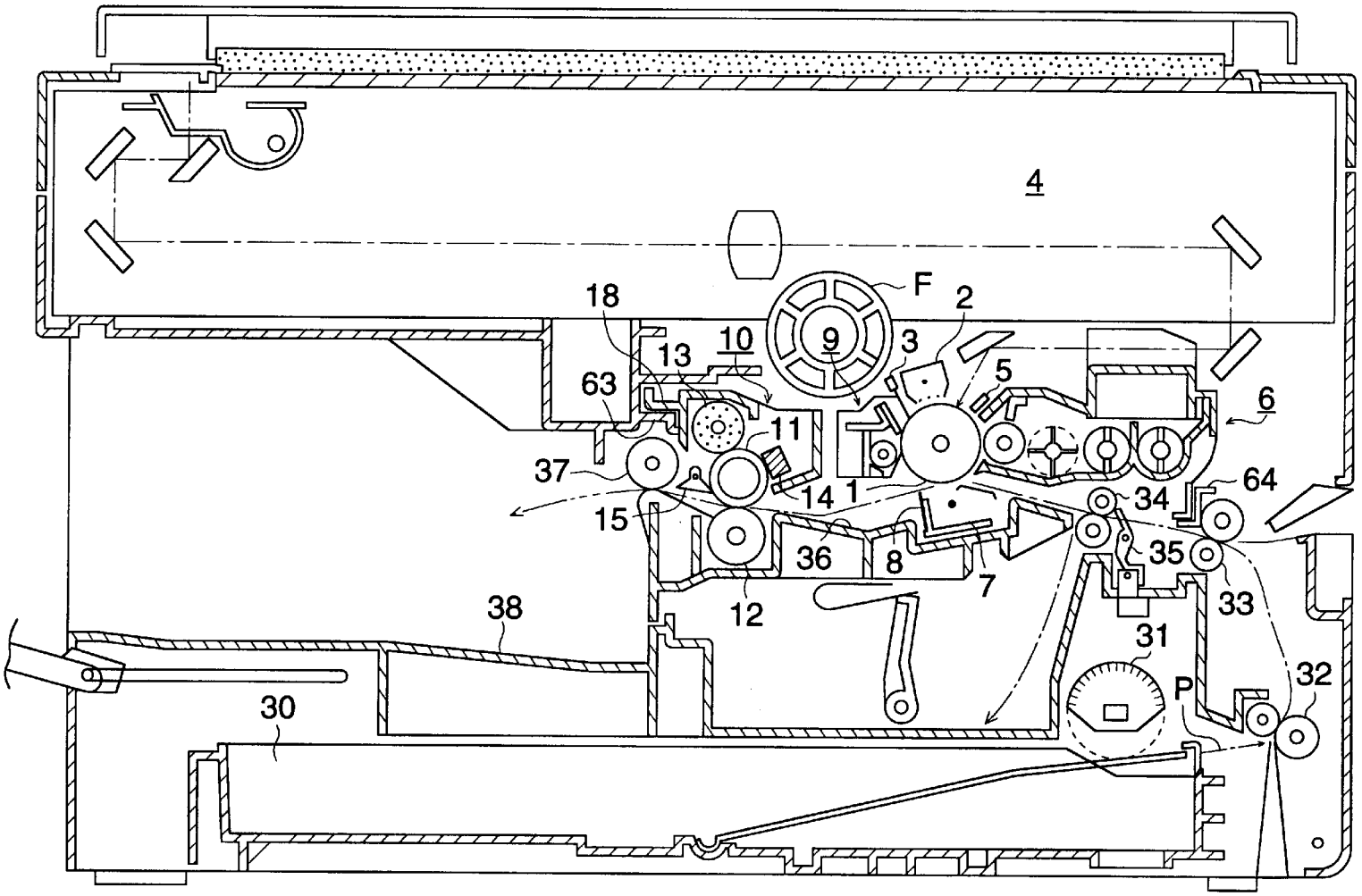
FIG. 1 is a sectional view of an image forming apparatus equipped with a process cartridge.

In FIG. 1, the numeral 1 represents a photoreceptor drum representing an image carrier, 2 represents a scorotron charger, 3 represents a pre-charging lamp (PCL), 4 represents an imagewise exposure means, 5 represents a charge erasing LED array, 6 represents a developing device, 7 represents a transfer electrode, 8 represents a separation electrode, 9 represents a cleaning device and 10 represents a heat-fixing device.

The heat-fixing device 10 is composed of fixing-heat roller (hereinafter referred to as a heat roller) 11, fixing-pressure roller (hereinafter referred to as a pressure roller) 12, fixing-cleaning member (hereinafter referred to as a cleaning roller) 13, fixing-temperature sensor (hereinafter referred to as a temperature sensor) 14, fixing-separation claw (hereinafter referred to as a separation claw) 15 and sheet-ejecting roller 37.

The numerals 30–37 represent members in a sheet-feeding path, a conveyance path and a sheet-ejecting path. The numeral 30 represents a sheet-feeding cassette containing therein transfer material P, the numeral 31 represents a feed-out roller, 32, 33 and 34 represent paired sheet-feeding rollers, 35 represents a registration sensor, 36 represents a conveyance guide plate, 37 represents a sheet-ejecting roller and 38 represents a sheet delivery tray.

Figure 2:
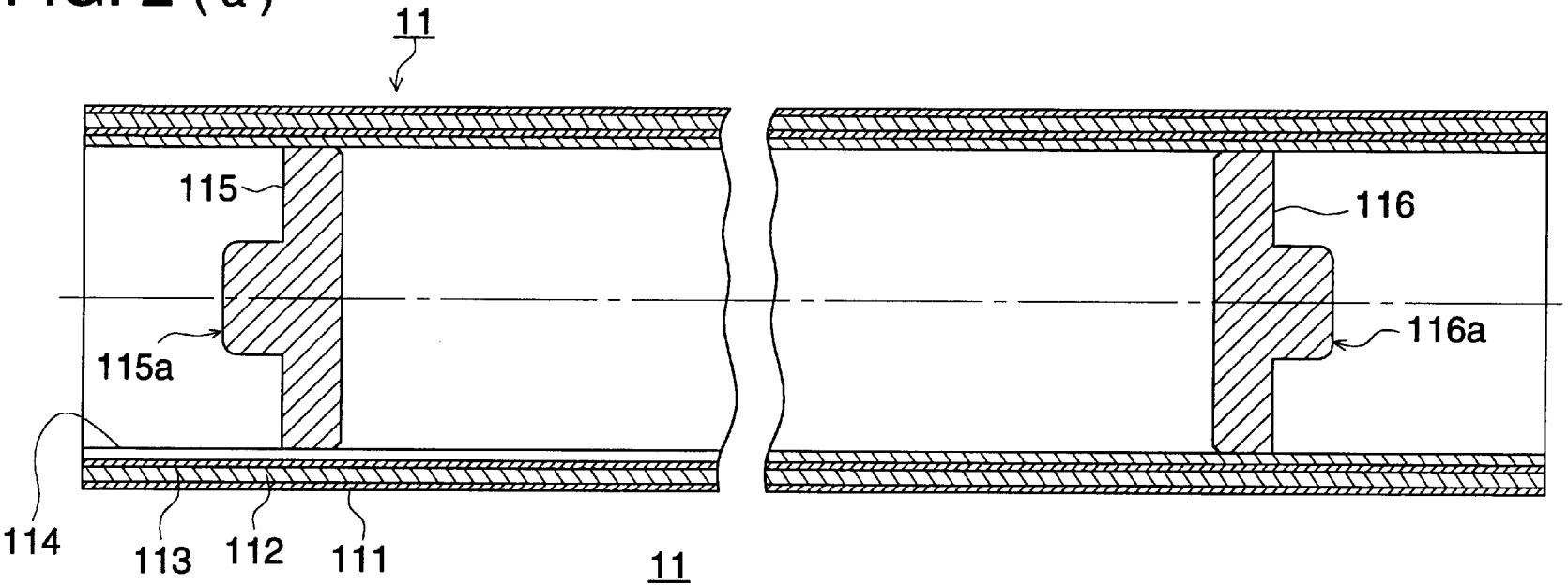
FIGS. 2(*a*) and 2(*b*) show respectively a side sectional view of a heat roller and a front sectional view of a heat roller.
Figure 2:
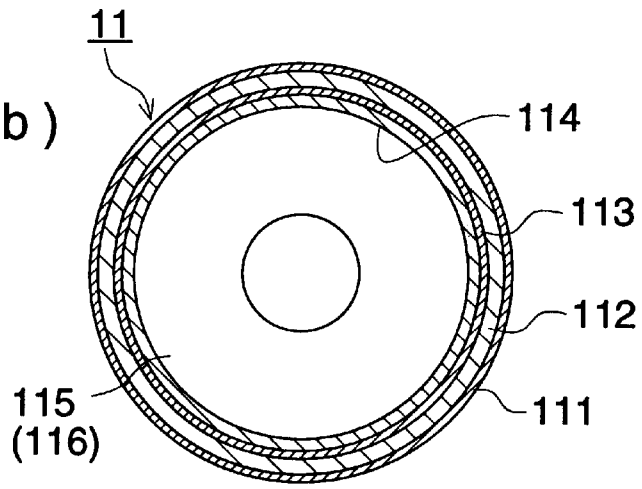

FIG. 2(*a*) is a side sectional view of heat roller 11, and FIG. 2(*b*) is a front sectional view of heat roller 11.

Heat roller 11 of the invention is a heat roller of an inner surface type wherein resistance heating element layer 114 is provided on an inner surface of cylindrical substrate (core metal) 112 composed of metallic conductive member such as aluminum alloy through insulator layer 113, and electrodes 115 and 116 are provided inside the resistance heating element layer 114 respectively at locations in the vicinity of both ends of the resistance heating element layer 114 in the direction of its roller shaft to be connected electrically to the resistance heating element layer 114. The numeral 111 represents a releasing layer which is composed of fluorine resin and covers the surface of the core metal 112. Inside the portions in the vicinity of both ends of the resistance heating element layer 114 in the direction of its roller shaft, there are inserted and fixed disk-shaped electrodes 115 and 116 both connected electrically to the resistance heating element layer 114. A tip portion of each of electrodes 115 and 116 fixed inside each of the portions in the vicinity of both ends of the heat roller 11 in the direction of its shaft is protruded, and its portion near its rotary shaft is shaped to be each of contact surface sections 115*a* and 116*a*.

Figure 3:
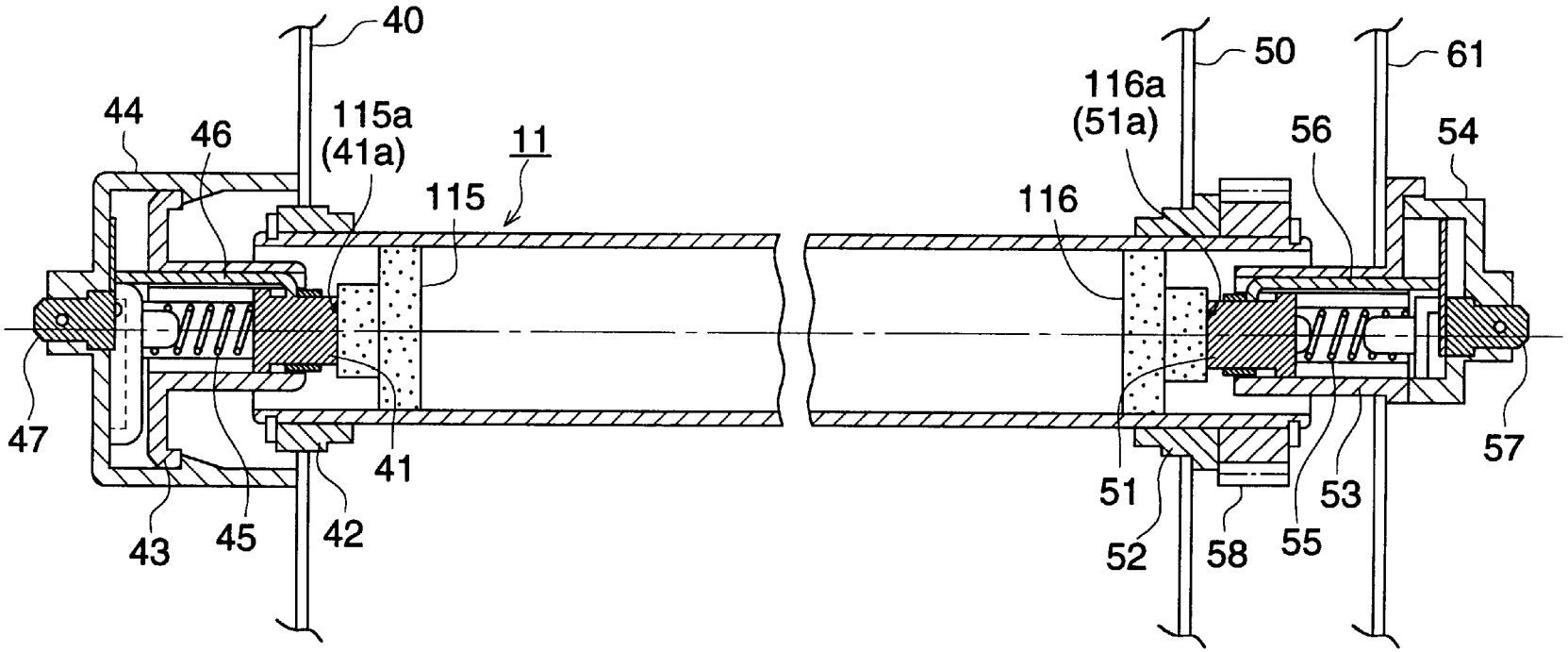
FIG. 3 is a sectional view of primary parts of a heat-fixing device.

FIG. 3 is a sectional view of primary portions of a heat-fixing device.

Contact surface sections 115*a* and 116*a* of heat roller 11 come in contact respectively with tip portions 41*a* and 51*a* of power-supplying brushes 41 and 51 to rotate while they slide on the tip portions 41*a* and 51*a*. Incidentally, the contact surface sections 115*a* and 116*a* or the tip portions 41*a* and 51*a* may also be formed to be a spherical surface or a curved surface whose radius of curvature is great.

Outer circumferential surfaces at both end portions of the heat roller 11 in its axial direction are supported rotatably by adiabatic and heat-resistant bearing members (hereinafter referred to as bearings) 42 and 52 which are fixed on side plates (housing) 40 and 50.

Tip portion 41*a* of power-supplying brush 41 comes in contact with contact surface section 115*a* of electrode 115 shown on the left side in the drawing to slide rotatably. Holder 43 is positioned and fixed in cover 44. The cover 44 is fixed on side plate 40. Between a inner wall of the cover 44 and a rear end portion of power-supplying brush 41, there is inserted pressure spring 45. The power-supplying brush 41 is pressed by the pressure spring 45 to be brought into pressure contact with contact surface section 115*a* of electrode 115. Under the condition of this pressure contact, the contact surface section 115*a* comes in contact rotatably with the tip portion 41*a* of the power-supplying brush 41 to slide thereon.

On a part of the side of the power-supplying brush 41, there is fixed an end of lead wire 46. The other end of the lead wire 46 is connected to power-supplying terminal 47. The power-supplying terminal 47 is connected to the power supply through an unillustrated wiring means.

Tip portion 51*a* of power-supplying brush 51 slides rotatably on contact surface section 116*a* of electrode 116 shown on the right side in the drawing. An outer circumferential surface of the power-supplying brush 51 slides on an inner surface of holder 53, and is guided to be movable in the axial direction of heat roller 11. The holder 53 is positioned and fixed on cover 54. The cover 54 is fixed on main body panel 61 located in the inner part. Between a inner wall of the cover 54 and a rear end portion of power-supplying brush 51, there is inserted pressure spring 55. The power-supplying brush 51 is pressed by the pressure spring 55 to be brought into pressure contact with contact surface section 116*a* of electrode 116. Under the condition of this pressure contact, the contact surface section 116*a* comes in contact rotatably with the tip portion 51*a* of the power-supplying brush 51 to slide thereon.

On a part of the side of the power-supplying brush 51, there is fixed an end of lead wire 56. The other end of the lead wire 56 is connected to power-supplying terminal 57. The power-supplying terminal 57 is connected to the power supply through an unillustrated wiring means.

On the right end portion of the heat roller 11 in the drawing, there is fixed gear 58. The gear 58 is connected to an unillustrated driving source to rotate the heat roller.

Electric power supplied from the power source forms an electricity path wherein the electric power is inputted in power-supplying terminal 47 through a wiring means, then it runs from lead wire 46 to power-supplying brush 41 and further runs from electrode 115 in heat roller 11 to be driven to rotate to heating resistor layer 114 of the heat roller 11 to heat it, and further runs from electrode 116 to power-supplying brush 51, lead wire 56 and power-supplying terminal 57.

By arranging electrodes 115 and 116 of heat-fixing device 10 at the center of rotation of heat roller 11, it is possible to conduct stable power supply with the electrical contact which is carried out at the center of the heat roller 11 and at the position where the sliding speed is low.

By making power-supplying brushes 41 and 51 to be in contact with the center of rotation of electrodes 115 and 116 which are hardly affected by mounting accuracy for parts such as eccentricity and surface conditions, it is possible to maintain stably the contact between electrodes 115 and 116 and power-supplying brushes 41 and 51, even under the condition of rotation.

Figure 4:
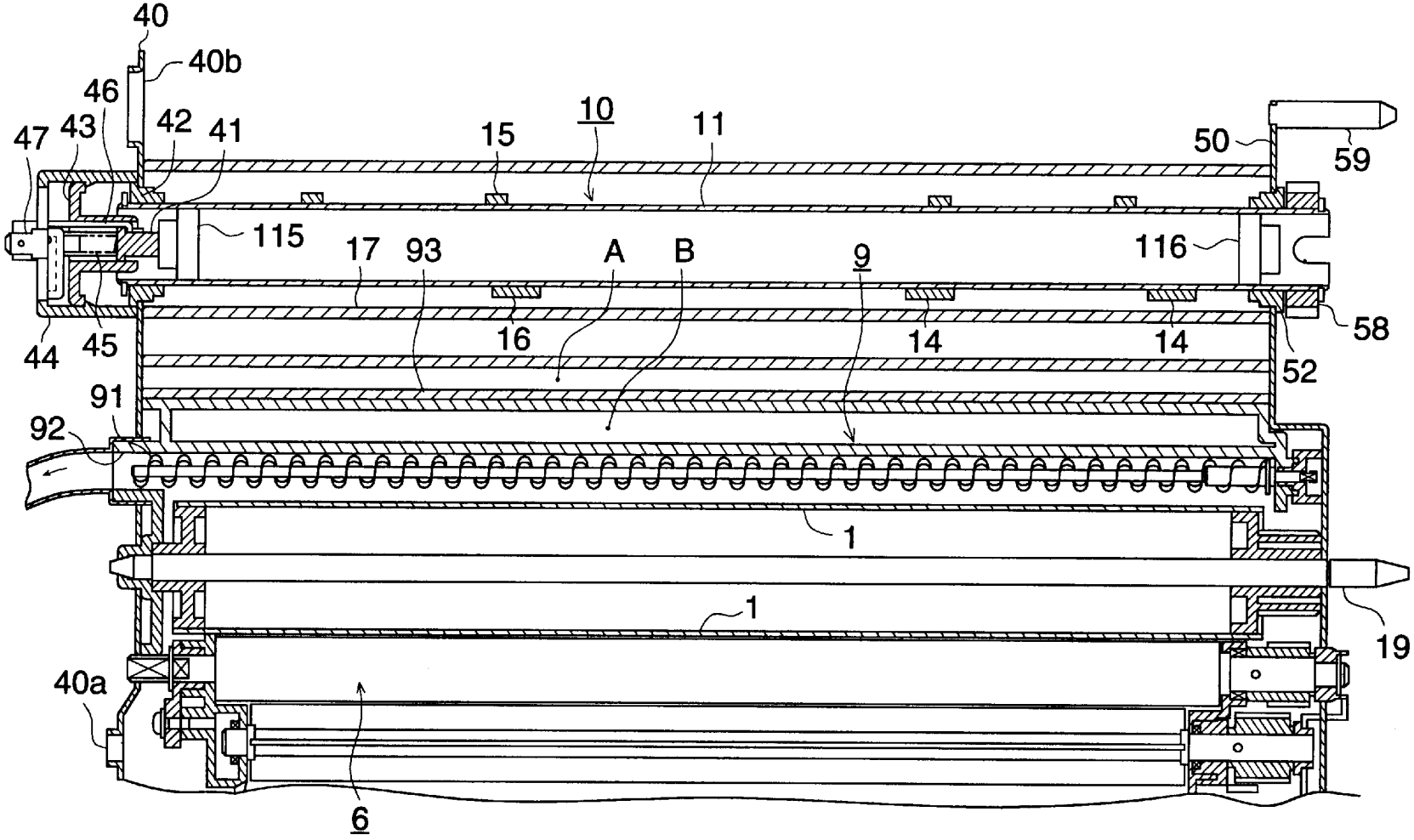
FIG. 4 is a lateral section of a process cartridge.
Figure 5:
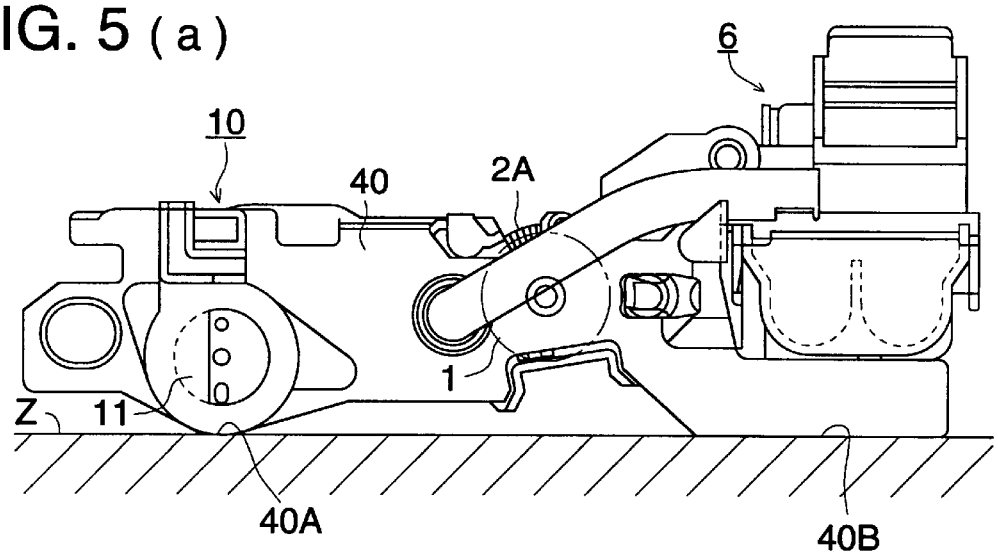
FIGS. 5(*a*), 5(*b*) and 5(*c*) show respectively a front view, a rear view and a longitudinal section of a process cartridge.
Figure 5:
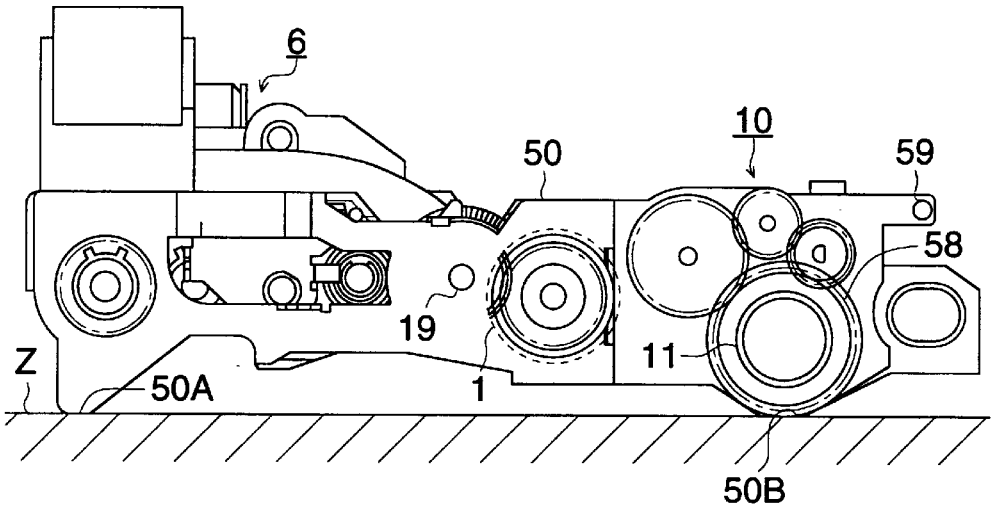
Figure 5:
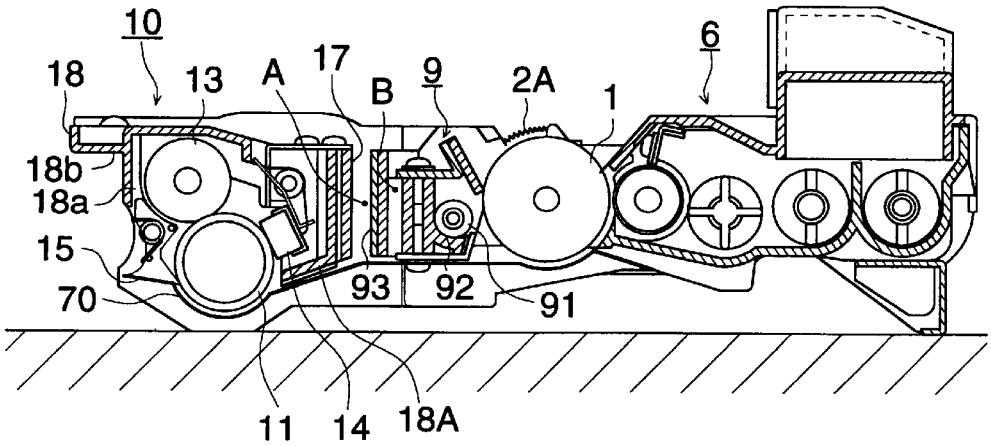

FIG. 4 is a lateral sectional view of a process cartridge related to the invention. FIG. 5(*a*) is a front view of the process cartridge, FIG. 5(*b*) is a rear view and FIG. 5(*c*) is a longitudinal sectional view.

The process cartridge of the invention is composed of image carrier (hereinafter referred to as a photoreceptor drum) 1, a part (grid wire 2A) of scorotron charger 2, developing device 6, cleaning device 9 and a part (heat roller 11 and its peripheral members) of heat-fixing device 10.

In the scorotron charger 2, grid wire 2A is arranged to be fixed on a discharge electrode, a shield casing is arranged to be fixed on the part of a process cartridge, and the discharge electrode and the shield casing are arranged on the part of the main body of an image forming apparatus.

In the heat-fixing device 10, heat roller 11, cleaning roller 13, temperature sensor 14, separation claw 15 and fixing abnormal temperature detecting member 16 (see FIG. 4) are arranged to be fixed on the part of the process cartridge, while pressure roller 12, sheet-ejecting roller 37 and pressure means are arranged on the part of the main body of an image forming apparatus.

Heat roller 11, bearings 42 and 52 rotatably supporting both end portions of the heat roller 11 and gear 58 driving the heat roller 11 for rotation are supported by side plates 40 and 50. A voltage impressing means shown on the left side in FIG. 4 and is composed of power-supplying brush 41, holder 43, cover 44, pressure spring 45, lead wire 46 and power-supplying terminal 47 is arranged to be fixed on the part of side plate (forward housing) 40 on this side. The voltage impressing means connected to electrode 116 shown on the right side in FIG. 4, namely, power-supplying brush 51, holder 53, cover 54, pressure spring 55, lead wire 56, and power-supplying terminal 57 are arranged to be fixed on main body panel 61 in the inner part. When the process cartridge is loaded on the main body of an image forming apparatus, therefore, contact surface section 116*a* of electrode 116 comes in pressure contact with tip portion 51*a* of power-supplying brush 51, whereby it is possible to supply electric power (see FIG. 6).

Constituting members such as photoreceptor drum 1, developing device 6, cleaning device 9, and heat-fixing device 10 which constitute the process cartridge are supported and arranged on the structured body composed of forward housing 40 and side plate in the inner part (housing). At two locations on the bottom of side plate 40 on this side, there are integrally provided protrusion-shaped cartridge supporting sections 40A and 40B (see FIG. 5(*a*)), and at two locations on the bottom of rear housing 50, there are integrally provided protrusion-shaped cartridge supporting sections 50A and 50B (see FIG. 5(*b*)). When the process cartridge is placed on plane Z of a work bench, cartridge supporting sections 40A, 40B, 50A and 50B touch the plane Z to prevent the photoreceptor drum 1 and fixing-heat roller 11 from touching the plane Z.

Since the photoreceptor drum 1 and the heat roller 11 are exposed on the part of the bottom of the process cartridge, there is a fear that the process cartridge is contaminated with dust or damaged by external force before it is loaded on the main body of an image forming apparatus, and in particular, deterioration of photoconductivity caused by external light might be created on the photoreceptor drum 1. For solving these problems, there has been devised an arrangement wherein sealing member 70 is placed and stuck on each of a lower exposed surface of the heat roller 11 and a lower exposed surface of the photoreceptor drum 1 to cover it in advance, and the sealing member 70 can be exfoliated to be drawn out and removed from the heat roller 11 and the photoreceptor drum 1, when loading the process cartridge (see FIG. 5(*c*)).

Next, there will be explained a means to prevent photoreceptor drum 1 and cleaning device 9 from being affected by radiant heat generated from heat roller 11.

(1) Heat insulating and heat-resistant bearings 42 and 52 are fixed respectively on front side plate 40 and rear side plate 50, and both end portions of heat roller 11 are supported rotatably to prevent heat generated from the heat roller 11 from being transmitted to the side plates 40 and 50.

(2) Heat insulating member 17 made of heat-resistant resin is provided at the position which is in the vicinity of heat roller 11 and is on the side for the heat roller 11 to face photoreceptor drum 1. As the heat insulating member 17, resin materials having high thermal deformation temperature and high maximum temperature for use such as polyphenylene sulfide (PPS), phenol resin (PF), polyamide-imide (PAI), polyimide (PI), and polyether etherketone (PEEK) are used. Installation of the heat insulating member 17 prevents that radiant heat generated from heat roller 11 causes temperature rise on cleaning device 9.

(3) Hollow portions for air flow A and B are formed between fixing-heat roller 11 and cleaning device 9, and cooling fan F mounted on the main body of an image forming apparatus prevents temperature rise on cleaning device 9, cools photoreceptor drum 1 and ejects ozone.

(4) Infrared ray reflecting member 93 is attached on the outer wall of cleaning device 9 forming the hollow portions for air flow A on the part thereof facing heat roller 11 to prevent temperature rise on the cleaning device 9. The infrared ray reflecting member 93 is one wherein an aluminum evaporation film is provided on the surface of either one of a heat-resistant glass base board, a ceramic base board, and a plastic base board, and it is mounted on the outer wall of the cleaning device 9 through insertion, glueing or adhesion by means of an adhesive double coated tape. Since the infrared ray reflecting member 93 of this kind can reflect infrared rays generated from heat roller 11 at the reflectance of 90% or more, temperature rise on the outer wall of cleaning device 9 can be controlled.

(5) A housing of cleaning device 9, especially toner guiding surface 92 which guides collected toner while touching toner conveyance screw 91 which conveys residual toner removed from photoreceptor drum 1 to one side of the process cartridge is formed with heat insulating resin. Due to this, temperature rise on the toner guiding surface 92 and on the toner conveyance screw 91 can be prevented, fusion of toner can be prevented, and toner can be conveyed smoothly.

(6) A part of heat roller 11 is surrounded by enclosure member 18 made of heat-resiseparatesin, and holding section 18*a* for separation claw 15 which touches heat roller 11 and sliding guide surface 18*b* which touches process cartridge guiding rail 63 (see FIG. 1) fixed on the main body of an image forming apparatus are formed solidly with the enclosure member 18. Due to this, heat conduction to separation claw 15 and to rail 63 can be reduced.

On the prescribed position for rear housing 50 of the process cartridge, there is studded positioning guide pin 59. A tip portion of a rotary shaft of photoreceptor drum 1 arranged to be provided between forward housing 40 and rear housing 50 is protruded out of the rear housing 50 to serve also as positioning guide pin 19. Therefore, the rear housing 50 of the process cartridge can be positioned by two positioning guide pins 19 and 59 both fixed at prescribed positions.

At the prescribed position of forward housing 40 on the part of developing device 6, there is formed positioning reference hole 40*a*, and at the prescribed position of the forward housing 40 in the vicinity of a heat-fixing device, there is formed positioning sub-reference hole 40*b*. Incidentally, the positioning sub-reference hole 40*b* is an elongated hole having its major distance in the direction to connect with the positioning reference hole 40*a* (see FIG. 4).

Figure 6:
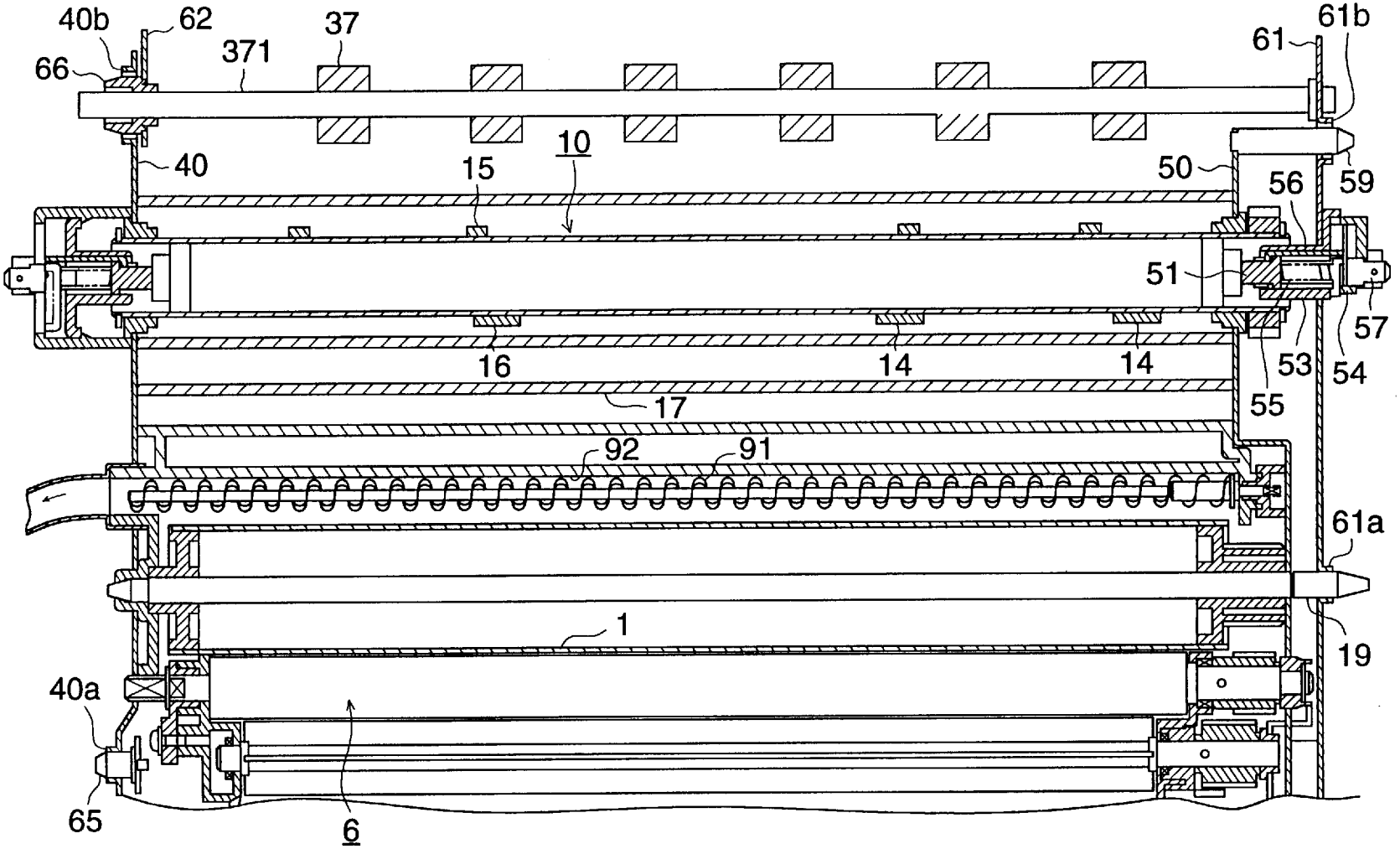
FIG. 6 is a lateral section showing a process cartridge mounted on the main body of an image forming apparatus.

FIG. 6 is a lateral sectional view showing how a process cartridge is mounted on the main body of an image forming apparatus.

On main body panel 61 in the inner part on the part of the main body of an image forming apparatus, the portion to fix heat-fixing device 10 where the power supplying brush 51 is to be supported is fixed, and two positioning reference holes 61*a* and 61*b* are formed. Positioning guide pin 19 on the part of a process cartridge engages with the positioning reference hole 61*a*, while positioning guide pin 59 engages with the positioning sub-reference hole 61*b*. Incidentally, the positioning sub-reference hole 61*b* is an elongated hole having its major distance in the direction to connect with the positioning reference hole 61*a*.

At the prescribed position on the upstream side of heat-fixing device 10 of main body panel (or a panel on which imagewise exposure means 4 is mounted) 62 located on this side in the direction to convey recording sheets, there is studded guide pin (reference pin) 65 on the part of the main body. The guide pin 65 on the part of the main body engages with positioning primary reference hole 40*a* on forward housing 40 of the process cartridge.

Rotary shaft 371 of sheet-ejecting roller 37 positioned at the downstream side of the heat-fixing device 10 in the direction to convey recording sheets is supported rotatably by bearing members provided between front and rear main body panels 61 and 62 of the main body of the image forming apparatus. Namely, the bearing member 66 which supports the rotary shaft 371 of the sheet-ejecting roller 37 on this side where a process cartridge is loaded has an outer circumferential portion protruded outside from the main body panel 62 on this side of the main body of the image forming apparatus, and it serves also as guide pin (reference pin) 66 on the part of the main body. This guide pin 66 on the part of the main body engages, when a process cartridge is loaded on the main body of the image forming apparatus, with positioning sub-reference hole 40*b* formed on the forward housing 40 to position the forward housing 40.

FIG. 7(*a*) is a longitudinal sectional view showing a process cartridge before it is loaded on an image forming apparatus.

On the enclosure member 18 of the heat-fixing device 10, there are arranged fixing members being located around heat roller 11 such as cleaning roller 13, fixing temperature sensor 14, separating claw 15, fixing abnormal temperature detecting member 16 and heat insulating member 17. An end portion on one side of the enclosure member 18 (left end portion in the drawing) is supported rotatably on swing-supporting shaft 20 that is provided between forward housing 40 and rear housing 50 both of a process cartridge. Further, arm member 21 is supported rotatably on the swing-supporting shaft 20. A hole formed on the tip portion of the arm member 21 is engaged with shaft 22 provided projectingly on the separating claw 15, and the separating claw 15 is supported rotatably by the arm member 21. Twisted coil spring 23 is wound around the shaft 22 to urge the tip portion of the separating claw 15.

A holding member which supports the fixing temperature sensor 14 and the fixing abnormal temperature detecting member 16 is supported rotatably on shaft 25, and twisted coil spring 26 urges the fixing temperature sensor 14 and the fixing abnormal temperature detecting member 16.

The enclosure member 18 supporting fixing members around the heat roller 11 and the arm member 21 are urged by an unillustrated spring means, and are held to be opened. In this state of open, it is possible to clean and repair the heat roller and peripheral fixing members having retreated from the heat roller 11 easily.

FIG. 7(*b*) is a longitudinal sectional view showing how the process cartridge is loaded on an image forming apparatus.

When the process cartridge is pushed in the inner part of the main body of the image forming apparatus along rails 63 and 64 shown in FIG. 1, while the process cartridge is held, the enclosure member 18 and the arm member 21 are swung around the swing-supporting shaft 20 by an unillustrated cam mechanism or a link mechanism to be moved toward the heat roller 11 to be stopped at the prescribed position.

Effects of a process cartridge of an image forming apparatus of the invention will be enumerated as follows.

(1) Unlike the prior art, manhours required for maintenance of a process cartridge and a fixing-heat roller can be reduced sharply, and the positional relation between a photoreceptor drum and the fixing-heat roller can easily be attained accurately.

(2) When a process cartridge is drawn out of the main body of an image forming apparatus and is placed on a plane bench, a cartridge supporting portion at the bottom of a housing of the process cartridge touches the surface of the plane bench to prevent the surfaces of a photoreceptor drum and a heat roller from being damaged.

(3) By arranging a hollow portion for air flow, an infrared ray reflecting member and a heat insulating resin member in the space adjoining a cleaning device facing the heat-fixing device, it is possible to intercept radiant heat generated from a heat roller, thereby preventing temperature rise on a cleaning device and preventing thermal condensation of toner in the cleaning device and decreasing of toner transportability.

(4) By forming an enclosure member of a heat roller with heat insulating resin and by making the enclosure member to be a sliding guide surface for a process cartridge, it is possible to intercept an influence of heat from the heat roller and thereby allow the process cartridge to slide smoothly for insertion or removal. Further, heat conduction from a separating claw which is in pressure contact with the heat roller is also intercepted.

(5) By covering the lower exposed surface of a heat roller with a sealing member, and by making it to be removable, it is possible to prevent occurrence of damage of the heat roller mounted on a process cartridge before it is loaded on the main body of an image forming apparatus and to prevent dust adhesion.

(6) By making the sealing member covering a heat roller to be one which is extended to the position where the lower exposed surface of a photoreceptor is covered to be capable of being drawn out, it is possible to prevent occurrence of damage of the photoreceptor drum mounted on a process cartridge before it is loaded on the main body of an image forming apparatus and to prevent dust adhesion, and deterioration of photoconductivity caused by external light.

(7) By making a forward housing and a rear housing of a process cartridge as well as a front and rear panels of the main body of an image forming apparatus to be positioned and combined through engagement of a reference hole and a guide pin, it is possible to position accurately a constituting member on the part of an insertable and removable process cartridge and a constituting member on the part of the main body of an image forming apparatus.

(8) By making various kinds of fixing members arranged around a heat roller of a process cartridge to be moved in the direction to be retreated from the outer circumferential surface of the heat roller in an open state, it is possible to easily clean and repair the peripheral fixing members retreated from the heat roller and the outer circumferential surface of the heat roller.

(9) A heat-fixing device related to the invention can be applied to a fixing roller fixing device housing having therein a halogen lamp and a fixing device having therein a fixing film in particular, when it is applied to a heat-fixing device having therein a heat roller which has on its inner surface a resistance heating element layer and an electrode fixed on both end portions of the roller, it is possible to reduce sharply manhours required for maintenance of the heat roller and a process cartridge.

What is claimed is:

1. A process cartridge for use in an image forming apparatus, comprising:

(a) a photoreceptor for bearing an image thereon;

(b) a processing member for image formation;

(c) a heat roller included in a heat fixing device for fixing a developed image formed on a recording sheet;

(d) a sheet-ejecting roller having a rotary shaft provided downstream of said heat roller; and (e) a front casing on which a reference hole is provided at a predetermined position for positioning said process cartridge when said process cartridge is loaded to said image forming apparatus, wherein said photoreceptor, said processing member, said heat roller, said sheet-ejecting roller, and said front casing are integrally provided on said process cartridge which is attachable to said image forming apparatus, and wherein said rotary shaft is rotatably supported by bearing members provided between a front and a rear panel of a main body of said image forming apparatus, and said reference hole of the front casing of said process cartridge is fitted to a periphery of either of said bearing members such that said rotary shaft serves—a function of serving also as a positioning reference pin for positioning said process cartridge to said apparatus, wherein a part of a front frame of each of said bearing members is protruded outward with respect to said front panel of said main body of said apparatus.

2. A process cartridge for use in an image forming apparatus, comprising:

(a) a photoreceptor for bearing an image thereon;

(b) a processing member for image formation;

(c) a heat roller included in a heat fixing device for fixing a developed image formed on a recording sheet;

(d) a fixing member provided in a periphery of said heat roller, including a fixing sensor, a fixing abnormal temperature detector, a fixing cleaning member and a fixing separating claw, wherein said photoreceptor, said processing member, said heat roller and said fixing member are integrally provided on said process cartridge which is attachable to said image forming apparatus, and wherein said fixing member is moved in conjunction with an insertion of said process cartridge in a direction retracting from an outer circumferential surface of said heat roller, and when said process cartridge is completely loades in a main body of said image forming apparatus, at least one of said fixing sensor, said fixing abnormal temperature detector, said fixing cleaner element, and said separate claw is set to a predetermined peripheral position of said heat roller.

3. A process cartridge for use in an image forming apparatus comprising:

(a) a photoreceptor for bearing an image thereon;

(b) a processing member for image formation;

(c) a heat roller included in a heat fixing device for fixing a developed image formed on a recording sheet;

wherein said photoreceptor, said processing member and said heat roller are integrally provided on said process cartridge which is attachable to said image forming apparatus;

(d) heat-resistant bearings, fixed on a casing of said process cartridge, rotatably supporting both ends of said heat roller; and (e) a heat-resistant heat insulating material provided in the vicinity of said heat roller and facing said photoreceptor.

4. The process cartridge of claim 3 further comprising a cartridge supporting portion provided on a bottom portion of a casing of said process cartridge for supporting said process cartridge so that said cartridge supporting portion comes in contact with a plane surface when said process cartridge is placed on said plane surface, and thereby said photoreceptor and said heat roller do not come in contact with said plane surface.

5. The process cartridge of claim 3 further comprising:

a cleaning device for cleaning a residual toner on said photoreceptor: and a hollow portion provided between said heat roller and said cleaning device through which air is circulated, wherein when said process cartridge is attached to said image forming apparatus, cooling of said photoreceptor and exhaust of ozone are conducted by a cooling fan provided on said image forming apparatus through said hollow portion.

6. The process cartridge of claim 3 further comprising:

a cleaning device for cleaning a residual toner on said photoreceptor, wherein said cleaning device comprises a toner conveyance screw provided in parallel to a rotary shaft of said photoreceptor for conveying the residual toner removed from said photoreceptor to one end of said process cartridge, and a toner guiding surface for guiding the residual toner conveyed by said toner conveyance screw, wherein said toner guiding surface positioned on a side facing said heat roller is formed of a heat insulating resin.

7. The process cartridge of claim 3, wherein said heat roller has a resistance heat generator, and electrodes are fixed at both ends of a roller of said heat roller.

8. A process cartridge for use in an image forming apparatus comprising:

(a) a photoreceptor for bearing an image thereon;

(b) a processing member for image formation;

(c) a heat roller included in a heat fixing device for fixing a developed image formed on a recording sheet;

wherein said photoreceptor, said processing member and said heat roller are integrally provided on said process cartridge which is attachable to said image forming apparatus;

(d) a cleaning device for cleaning a residual toner on said photoreceptor;

(e) a hollow portion provided between said heat roller and said cleaning device through which air is circulated by a cooling device mounted on said image forming apparatus; and (f) an infrared ray reflecting member provided on an outer wall of said cleaning device on a side facing said heat roller.

9. A process cartridge for use in an image forming apparatus comprising:

(a) a photoreceptor for bearing an image thereon;

(b) a processing member for image formation;

(c) a heat roller included in a heat fixing device for fixing a developed image formed on a recording sheet;

wherein said photoreceptor, said processing member and said heat roller are integrally provided on said process cartridge which is attachable to said image forming apparatus;

(d) an upper frame made from heat insulating resin by which an upper space over said heat roller is surrounded;

(e) a holding portion for holding a separating claw in contact with said heat roller; and (f) a slide guiding surface in contact with a rail member fixed on said image forming apparatus for guiding said process cartridge, (g) wherein said holding portion and said slide guiding surface are integrally formed into one unit.

10. The process cartridge of claim 9 further comprising:

a sealing member for covering an exposed portion of said heat roller, wherein said sealing member is removable from said heat roller.

11. The process cartridge of claim 10 wherein said sealing member is arranged to cover an exposed portion of the photoreceptor.

12. The process cartridge of claim 9 further comprising:

a sealing member covering an exposed portion of said photoreceptor, wherein said sealing member is removable from said photoreceptor.

13. The process cartridge of claim 9 further comprising:

a front casing on which a positioning guide pin or a positioning reference hole is provided at a predetermined position; and a rear casing on which a positioning guide pin or a positioning reference hole is provided at a predetermined position, wherein said guide pin or said reference hole of said respective front and rear casings is fitted to a corresponding reference hole or guide pin provided on each corresponding predetermined position of said image forming apparatus.

14. A process cartridge for use in an image forming apparatus comprising:

(a) a photoreceptor for bearing an image thereon;

(b) a process member for image formation;

(c) a heat member included in a heat fixing device for fixing a developed image formed on a recording sheet; and (d) a heat insulating member comprising a heat resistant resin provided in the vicinity of the heat member and facing the photoreceptor, wherein the photoreceptor, the process member, the heat member, and a heat resistant heat insulating material are integrally provided in said process cartridge attachable to said image forming apparatus.

* * * * *